United States Patent [19]

Lauterburg et al.

[11] 4,451,719

[45] May 29, 1984

[54] PUSHBUTTON SWITCH FOR A TIMEPIECE

[75] Inventors: Rainer Lauterburg, Reinach, Switzerland; Hans Geiger, Hasel, Fed. Rep. of Germany

[73] Assignee: Societe Suisee pour l'Industrie Horlogere Management Services, S.A., Bienne, Switzerland

[21] Appl. No.: 22,233

[22] Filed: Mar. 20, 1979

[30] Foreign Application Priority Data

Mar. 24, 1978 [FR] France ..... 78 09966

[51] Int. Cl.[3] ..... H01H 3/12

[52] U.S. Cl. ..... 200/159 R; 200/77; 368/321

[58] Field of Search ..... 200/159 R, 67 A, 68, 200/77; 58/90 B, 23 R, 88 B

[56] References Cited

U.S. PATENT DOCUMENTS

| | | | |
|---|---|---|---|
| 3,600,533 | 8/1971 | English | 200/68 X |
| 3,879,934 | 4/1975 | Ikehata | 58/88 B |
| 3,974,351 | 8/1976 | Solov et al. | 220/159 R |
| 4,034,553 | 7/1977 | Wuthrich | 58/90 B X |
| 4,154,996 | 5/1979 | Arnold | 200/77 |

*Primary Examiner*—Steven M. Pollard

*Attorney, Agent, or Firm*—Griffin, Branigan & Butler

[57] ABSTRACT

A pushbutton switch for an electronic timepiece comprises a stem means which may be slid through a guide tube by pressure exerted theron against the force of a return spring and which is arranged to change the state of electrical contact means. At least one elastic member is arranged between the stem means and the guide tube and axially retained in an opening provided in one or the other of these elements so as to coact with a surface on the other element which surface has a sufficient variation in inclination so as to effect a snap or toggle action when the elastic member traverses said variation. The invention finds particular applications to electronic chronographs.

4 Claims, 8 Drawing Figures

PUSHBUTTON SWITCH FOR A TIMEPIECE

BACKGROUND OF THE INVENTION

The invention concerns a pushbutton switch for an electronic timepiece.

Pushbuttons presently utilized in respect of mechanical timepieces operate generally on a mechanism either to correct an indication or to engage or disengage a special function such as for example the counter in a chronograph. Because of this acting on a mechanism which goes from one state to another there occurs a discontinuity or an abrupt change in the force exerted on the pushbutton by the user this in general being indicated by a snap generally audible or at least a clear touch perception of a variation in the force exerted on the button. The user thus knows without it being necessary for him to make a visual verification that he has effectively accomplished the function required.

In the usual types of electronic timepieces functions are taken over by programmed circuits and the actuation of such circuits is accomplished by means of contact switches controlled by the user also generally through pushbuttons. Since mechanisms of the type found in mechanical timepieces are superfluous the operation of the function is no longer definitely sensed by the user. There is thus doubt as to the effectiveness of the action and necessity for a visual inspection. Such control often is not possible. This situation is further aggravated by a possible hesitation or shaking in the hand of the user. If he determines that his actuation has not produced an effect it is necessary for him to repeat it and verify once again the result. If the first actuation was synchronized with an event as for example an instant of start-up the effective starting moment would not correspond to the event in question and there would be considerable uncertainty as to the effective result of the measure which would greatly depend on the reaction time of the user. This uncertainty is all the more annoying since it is theoretically possible in view of electronics to obtain measurements to a hundredth of a second.

Attempts have been made to overcome this problem. For example the starting of the function will be coincident with the closing of an supplementary auxiliary circuit which may set off an audible signal. Such solution complicates the electronics and requires moreover the presence of a sonic signal for which the current consumption will not be negligible. Another proposed solution is to add to the electronic module itself a mechanism which would suddenly change state at the moment of being released in the function required. This, however, leads to the mechanical conception mentioned above and accordingly removes one of the principal advantages of an overall electronic construction which resides precisely in the removal of such mechanisms within the timepiece. The arrangement of a mechanism within the electronic module moreover causes serious technological problems which are difficult to solve in an economic fashion and which may moreover cause problems in respect of the reliability of the timepiece.

The present invention has as its purpose to resolve the problem of uncertainty of the user as to the reality of his engaging the function which he has attempted to actuate by providing the sensation of touch through the control pushbutton. He may thus operate on the pushbutton until he has perceived the phenomenon and will not require to verify visually the activity in order to be sure of the result obtained. This purpose is realized not through the addition of a mechanism within the electronic module but through the construction of the control pushbutton.

SUMMARY OF THE INVENTION

The pushbutton switch according to the invention comprises a stem means capable of an axial displacement relative to guide means fixed to the timepiece casing when urged by an operator against the force of a return spring, said axial displacement changing the state of electrical contact means wherein elastic means is interposed between an element of said stem means and an element of said guide means and is axially retained within an opening provided in one of said elements, a contact surface for said elastic means being provided in the other of said elements, said contact surface exhibiting a discontinuity or variation in form sufficient to effect a snap or toggle action in the relative movement between the stem means and guide means whenever the elastic means traverses said discontinuity or variation on said contact surface.

BRIEF DESCRIPTION OF THE DRAWINGS

On each figure the same elements are designated by the same reference numerals.

DETAILED DESCRIPTION OF THE INVENTION

Figure 1:
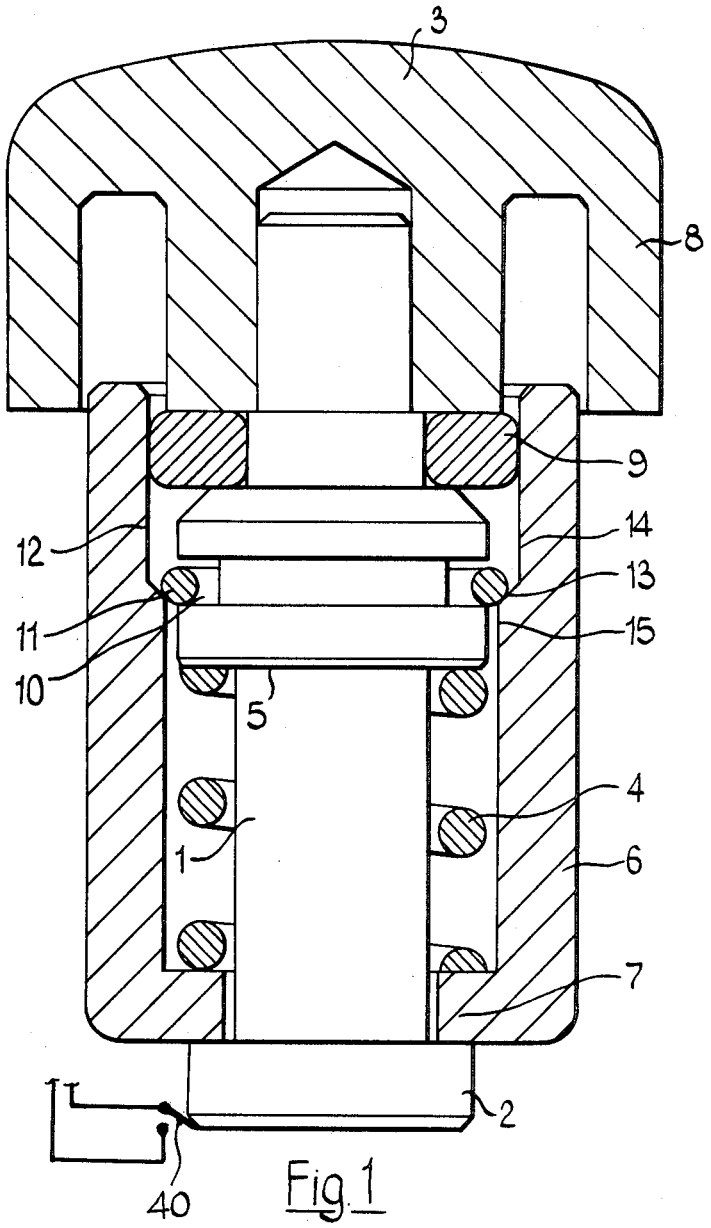
FIG. 1 shows in elevation a cross section of a first form of the invention.
Figure 2:
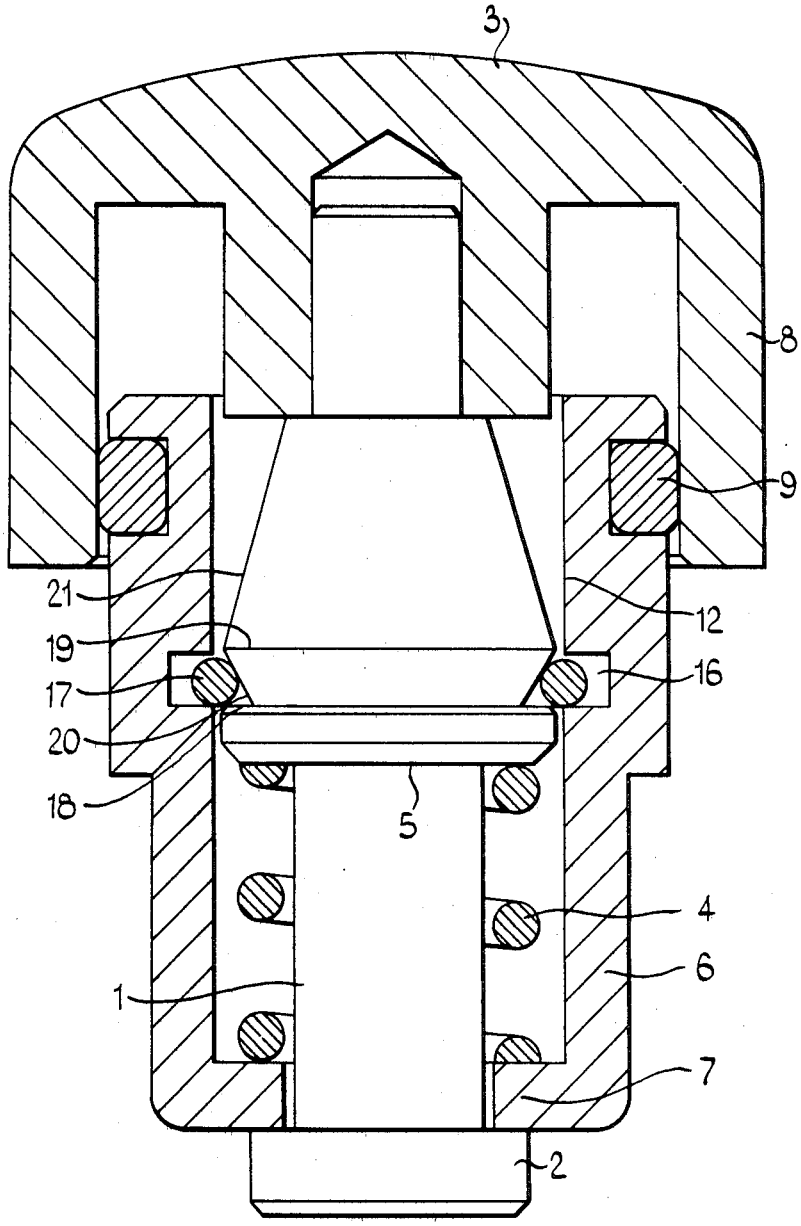
FIG. 2 shows in elevation a cross section of a second form of the invention.

The pushbutton switches shown comprise a stem in the form of a surface or revolution 1 of which the lower end 2 which acts as a switch when the stem 1 is axially displaced downwardly operates either directly or indirectly on an electric contact 40 in order to bring about the start or finish of the desired function, for example counting of an elapsed time which the timepiece (not shown) provided with the pushbutton is to assume. The upper end of stem 1 is fastened as for instance by screw threads to a pushbutton head 3 which is the element on which the user acts in order to bring about the axial displacement of stem 1. This displacement is effected against the upwardly directed force of a return spring 4, preferably of helical form, surrounding a portion of stem 1 and supported on the one hand on a fixed portion of, or relative to, the timepiece thus directly as in FIGS. 1 and 2, or indirectly as in FIGS. 3 and 4, on a support surface 5 of stem 1 or of the pushbutton head 3. Preferably the assembly formed by stem 1 and spring 4 traverses the case band of the timepiece at the interior of a guide tube 6 mounted in a corresponding hole cut through the case band (not shown). On the drawings the lower extremity of tube 6 shows a reentrant portion 7 of which the upper wall serves as a support surface for spring 4 and on the lower wall of which may abut in rest position the lower extremity 2 of stem 1, this extremity 2 having a greater cross section than the adjacent portion of stem 1 and the free space left by the reentrant portion 7. This arrangement prevents stem 1 from being expelled from tube 6 under the action of spring 4. In the example of FIGS. 1 and 2 in order to make possible the assembly in tube 6 the lower extremity 2 will have to be specially fitted onto stem 1.

For mainly aesthetic reasons and as well to provide protection the head of pushbutton 3 is advantageously, partially at least, in the form of a skirt 8 surrounding the upper extremity of tube 6 with a sufficient amount of play. In the examples shown in FIGS. 3 and 4, skirt 8 in conformity with the invention, also plays a role in obtaining a snap or toggle action as will be seen further on.

Figure 3:
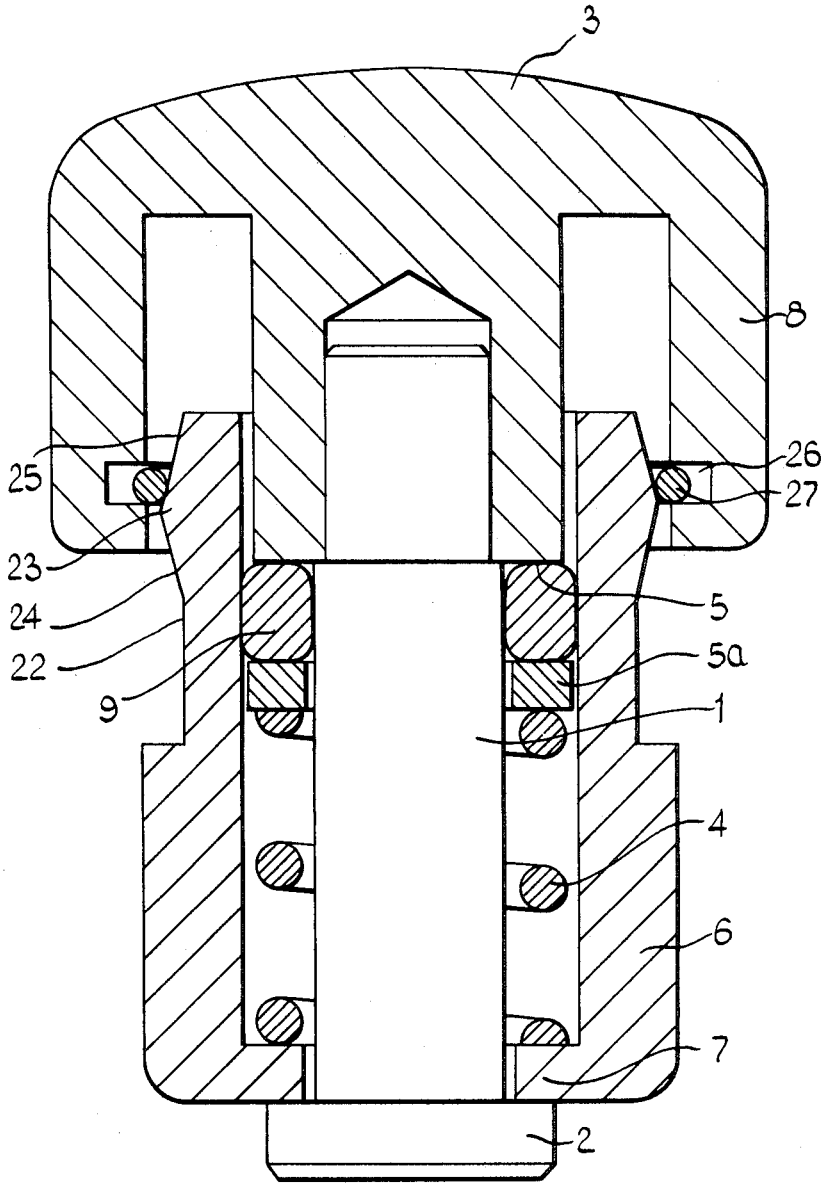
FIG. 3 shows in cross section an elevation of a third form of the invention.
Figure 4:
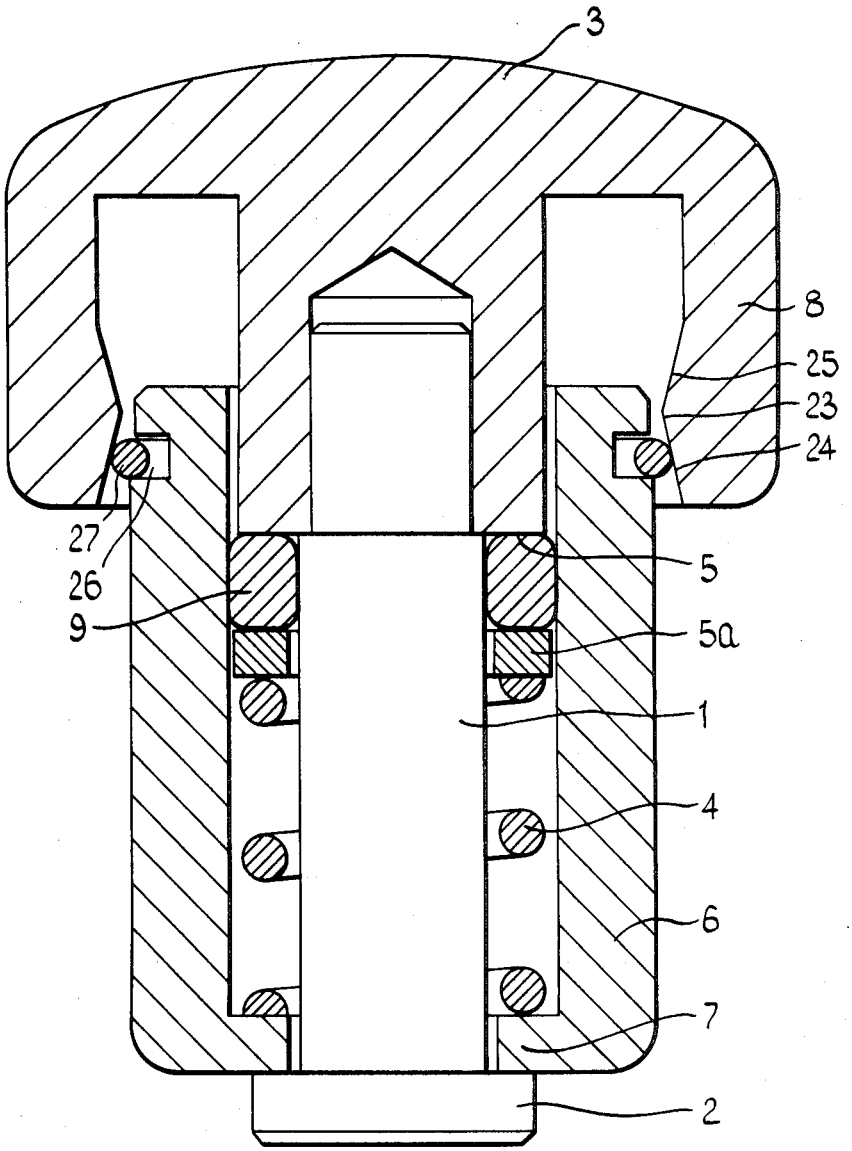
FIG. 4 shows in cross section an elevation of the fourth form of the invention.

The necessary sealing between exterior and interior of the timpiece is conventionally obtained by packing 9 placed either between stem 1 and the internal wall of tube 6 (FIGS. 1, 3 and 4) or between the external wall of tube 6 and the internal wall of skirt 8 (FIG. 2). In the examples of FIGS. 3 and 4 packing 9 is pressed between the lower extremity 5 of head 3 and a washer 5*a* urged upwardly by the spring 4 and serving as a support surface.

In the example of the invention shown in FIG. 1 stem 1 exhibits a groove 10 in which is placed with sufficient play an annular spring (or split ring) 11. The edges of groove 10 permit this spring only a very small axial displacement. Spring 11 is compressed during assembly and by its own elasticity tends to relax outwardly and thus is supported along its exterior edge against the internal wall 12 of tube 6. Wall 12 exhibits proximate spring 11 and going from top towards the bottom a progressive reduction in diameter so as to provide a surface such as a truncated cone forming a ramp 13 limited by the two cylindrical surfaces 14 and 15 of respectively a larger and a smaller diameter.

The arrangement functions as follows: at rest spring 11 is supported on the portion of larger diameter 14. If one pushes on head 3 annular spring 11 slides on ramp 13 its compression being increased until it has crossed the ramp thereafter resting on portion of small diameter 15 where compression once again becomes constant. In the increase of the necessary force for the displacement of stem 1 against the spring 4 there will thus be perceived discontinuity during the crossing of ramp 13, a discontinuity which will be clearly felt at the touch of the finger of the user through head 3. Also the user will know that he has gone far enough in order to actuate in a definite manner the switch through the extremity 2. It is obvious that the profile of ramp 13 could be somewhat different provided that it does not permit the annular spring 11 to become blocked through butting and that the variation of slope, even without any discontinuity should be sufficiently abrupt for the user to sense easily the corresponding variation in the force necessary.

Figure 5:
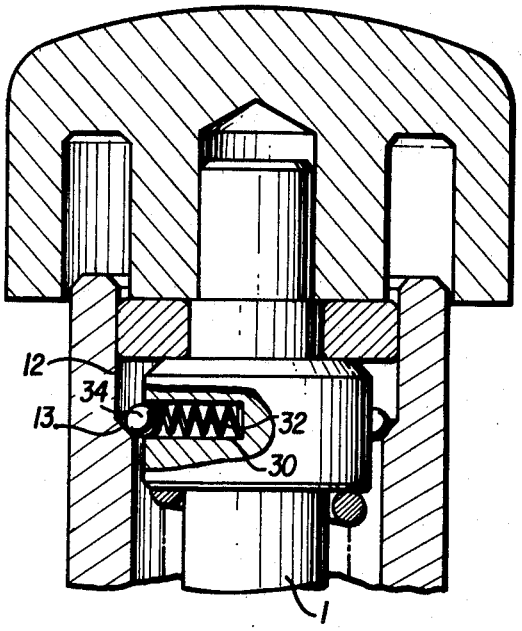
FIG. 5 is a partial view showing in elevation a cross section of a modification of the FIG. 1 embodiment.

Another arrangement, shown in FIG. 5, using the same type of ramp 13, comprises replacing groove 10 within stem 1 by one or several raidal holes 30 in which an outwardly acting spring 32 will urge a contact element such as for example a ball 34 towards the interior wall 12 of tube 6. In view of machining difficulties this latter solution is however much more difficult to implement than the preceding.

In another form of execution of the invention as shown in FIG. 2 the internal wall 12 of tube 6 is provided with a groove 16. The latter prevents all axial displacement except for a certain amount of play of an annular spring 17 or split ring which is lodged therein. Spring 11 is prestressed in order to exert a radially compressive force along its interior edge against the stem 1. The latter exhibits above a shoulder 18 a surface 19 having a discontinuous slope constituted by two truncated cone surfaces, a lower surface 20 and upper surface 21 having their large base in common.

Thus, as in the case of FIG. 1, when surface 19 is traversed, and more particularly the ridge comprising the common base of the two truncated conic surfaces 20 and 21 by the spring 17 pressing against these surfaces, the force of the thrust provided by the user on head 3 will show a discontinuity or at least a rapid variation should the sharp ridge be removed by giving surface 19 a more gentle profile.

Figure 6:
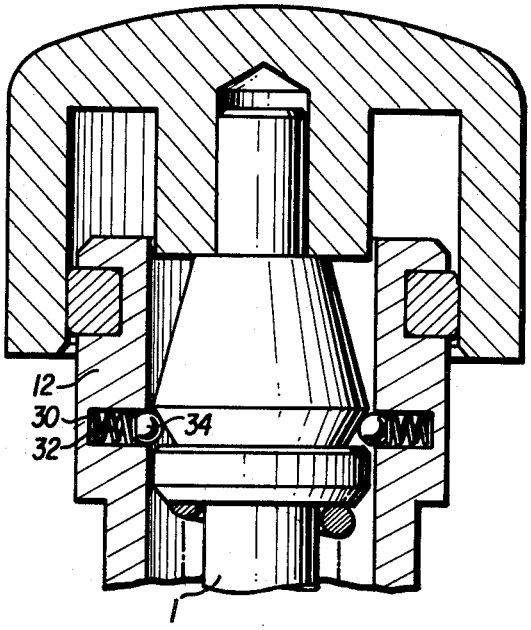
FIG. 6 is a partial view showing in elevation a cross section of a modification of the FIG. 2 embodiment.

Here again groove 16 and annular spring 17 may be replaced respectively by at least one blind hole 30 pierced in wall 12 and by a contact element such as a ball 34 urged towards stem 1 by a spring 32 placed in the hole as is depicted in FIG. 6.

In the version as shown in FIG. 3 the interior of tube 6 no longer serves to enclose the arrangement according to the invention and in this case skirt 8 of head 3 plays an active role. Here it is the outer wall 22 of tube 6 which at its upper extremity exhibits a ramp 23 comprising two truncated conic surfaces joined at their major bases. A groove 26 is arranged in the internal wall of skirt 8. Groove 26 axially maintains an annular spring 27 prestressed so as to apply a radial force along its inner edge against the surface of ramp 23. As in the case of the preceding solutions the functioning of the arrangement will be understood without further explanation.

FIG. 4 shows a similar arrangement wherein the roles of skirt 8 and tube 6 are inverted. In this case, groove 26 is placed in the outer wall of tube 6 and ramp 23, 24, 25 against which the spring 27 acts, is carried on the inner wall of the skirt 8.

Figure 7:
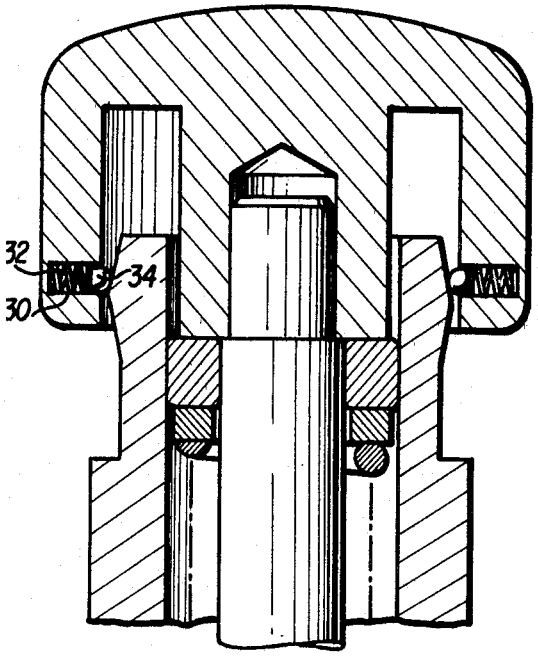
FIG. 7 is a partial view showing in elevation a cross section of a modification of the emodiment of FIG. 3.
Figure 8:
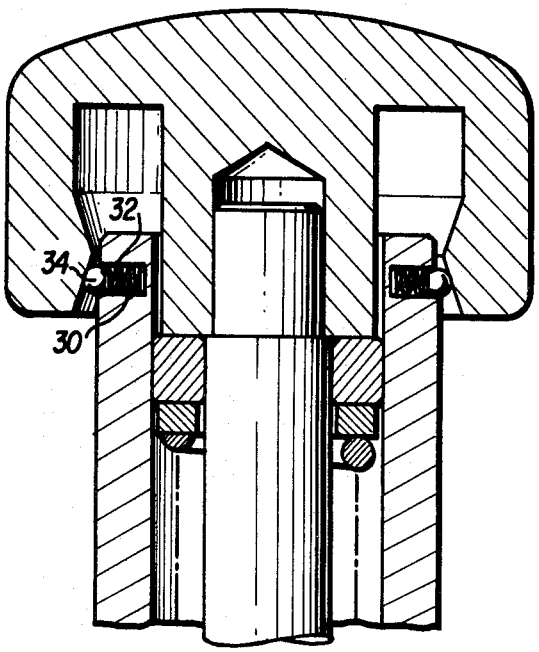
FIG. 8 is a partial view showing in elevation a cross section of a modification of the embodiment of FIG. 4.

In the two latter cases it is obvious that one may equally through a simple transposition arrange the functional equivalents which comprise the system having a blind hole 30, spring 32 and ball 34 as are depicted in FIGS. 7 and 8.

In the same manner as the solutions as proposed hereinabove to obtain a single snap, the invention may be applied without difficulty, in order to obtain several successive snaps corresponding to various displacements of the stem with various different functions. Thus, for example, the ramp already described could be elongated by a section exhibiting a suitable profile.

What we claim is:

1. A finger pushbutton switch for an electronic timepiece such as a chronograph, comprising a stem means capable of an axial displacement relative to guide means fixed to the timepiece casing when urged by the finger of an operator against the force of a return spring, said axial displacement changing the state of electrical contact means, wherein elastic means is interposed between an element of said stem means and an element of said guide means and is axially retained within an opening provided in one of said elements, a contact surface for said elastic means being provided in the other of said elements for contacting said elastic means, and thereby changing its shape upon further axial movement of said stem means, said contact surface exhibiting an axial discontinuity or variation in form, relative to the relaxed shape of said elastic means, sufficient to effect a snap or toggle action in the relative displacement between the stem means and guide means whenever the elastic means traverses said discontinuity or variation on said contact surface in a first direction due to the urging of said operator to thereby change the state of said electrical contact means and in a second direction due to urging of said spring to thereby change the state of said electrical contact means; wherein said guide means comprises a tube fixed within the timepiece casing, and wherein said elastic means comprises an annular spring axially retained within the groove provided in the stem means, the outer edge of said spring being supported on a ramp in truncated cone form provided on the interior wall of said tube.

2. A finger pushbutton switch for an electronic timepiece such as a chronograph, comprising a stem means capable of an axial displacement relative to guide means fixed to the timepiece casing when urged by the finger of an operator against the force of a return spring, said axial displacement changing the state of electrical contact means, wherein elastic means is interposed between an element of said stem means and an element of said guide means and is axially retained within an opening provided in one of said elements, a contact surface for said elastic means being provided in the other of said elements for contacting said elastic means, and thereby changing its shape upon further axial movement of said stem means, said contact surface exhibiting an axial discontinuity or variation in form, relative to the relaxed shape of said elastic means, sufficient to effect a snap or toggle action in the relative displacement between the stem means and guide means whenever the elastic means traverses said discontinuity or variation on said contact surface in a first direction due to the urging of said operator to thereby change the state of said electrical contact means and in a second direction due to urging of said spring to thereby change the state of said electrical contact means; wherein said guide means comprises a tube fixed within the timepiece casing; and wherein said elastic means comprises an annular spring axially retained within a groove provided in the interior wall of said tube, the inner edge of said spring being supported on a ramp in truncated cone form provided on the surface of said stem means.

3. A finger pushbutton switch for an electronic timepiece such as a chronograph, comprising a stem means capable of an axial displacement relative to guide means fixed to the timepiece casing when urged by the finger of an operator against the force of a return spring, said axial displacement changing the state of electrical contact means, wherein elastic means is interposed between an element of said stem means and an element of said guide means and is axially retained within an opening provided in one of said elements, a contact surface for said elastic means being provided in the other of said elements for contacting said elastic means, and thereby changing its shape upon further axial movement of said stem means, said contact surface exhibiting an axial discontinuity or variation in form, relative to the relaxed shaped of said elastic means, sufficient to effect a snap or toggle action in the relative displacement between the stem means and guide means whenever the elastic means traverses said discontinuity or variation on said contact surface in a first direction due to the urging of said operator to thereby change the state of said electrical contact means and in a second direction due to urging of said spring to thereby change the state of said electrical contact means; wherein said guide means comprises a tube fixed within the timepiece case; and, wherein said stem means is fixed at its outer end to a head element in the form of a skirt of approximately cylindrical form; and, wherein said elastic means comprises an annual spring axially retained within a groove provided on the interior wall of the skirt, the inner edge of said spring being supported on a ramp in truncated cone form provided on the exterior wall of said tube.

4. A finger pushbutton switch for an electronic timepiece such as a chronograph, comprising a stem means capable of an axial displacement relative to guide means fixed to the timepiece casing when urged by the finger of an operator against the force of a return spring, said axial displacement changing the state of electrical contact means, wherein elastic means is interposed between an element of said stem means and an element of said guide means and is axially retained within an opening provided in one of said elements, a contact surface for said elastic means being provided in the other of said elements for contacting said elastic means, and thereby changing its shape upon further axial movement of said stem means, said contact surface exhibiting an axial discontinuity or variation in form, relative to the relaxed shape of said elastic means, sufficient to effect a snap or toggle action in the relative displacement between the stem means and guide means whenever the elastic means traverses said discontinuity or variation on said contact surface in a first direction due to the urging of said operator to thereby change the state of said electrical contact means and in a second direction due to urging of said spring to thereby change the state of said electrical contact means; wherein said guide means comprises a tube fixed within the timepiece case; and, wherein said stem means is fixed at its outer end to a head element in the form of a skirt of approximately cylindrical form; and, wherein said elastic means comprises an annular spring axially retained within a groove provided on the exterior wall of said tube, the outer edge of said spring being supported on a ramp in truncated cone form provided on the interior wall of the skirt.

* * * * *